US006823614B2

(12) United States Patent
Mathison

(10) Patent No.: US 6,823,614 B2
(45) Date of Patent: Nov. 30, 2004

(54) RAIL BOUNDED SNOW BLOWER EQUIPMENT

(75) Inventor: Dennis R. Mathison, Maple Plain, MN (US)

(73) Assignee: Loram Maintenance of Way, Inc., Hamel, MN (US)

( * ) Notice: Subject to any disclaimer, the term of this patent is extended or adjusted under 35 U.S.C. 154(b) by 64 days.

(21) Appl. No.: 10/320,755

(22) Filed: Dec. 16, 2002

(65) Prior Publication Data

US 2003/0110665 A1 Jun. 19, 2003

Related U.S. Application Data

(60) Provisional application No. 60/340,578, filed on Dec. 14, 2001.

(51) Int. Cl.[7] ..... E01H 8/04; E01H 8/06

(52) U.S. Cl. ..... 37/198; 37/207; 37/210; 37/239

(58) Field of Search ..... 37/198, 207, 208, 37/209, 210, 211, 213, 223, 232, 234, 237, 238, 239, 240

(56) References Cited

U.S. PATENT DOCUMENTS

| | | | | | |
|---|---|---|---|---|---|
| 1,469,464 | A | * | 10/1923 | Ursino | 37/104 |
| 3,034,236 | A | * | 5/1962 | Pyke | 37/211 |
| 3,305,949 | A | * | 2/1967 | Holley | 37/213 |
| 3,589,296 | A | * | 6/1971 | Plasser et al. | 104/12 |
| 3,706,145 | A | * | 12/1972 | Bucksch et al. | 37/105 |
| 3,791,053 | A | * | 2/1974 | Breckbill | 37/225 |
| 3,886,675 | A | * | 6/1975 | Maisonneuve et al. | 37/211 |
| 4,053,183 | A | * | 10/1977 | Probst | 299/36.1 |
| 4,151,663 | A | | 5/1979 | Schmidt | 37/43 |
| 4,257,331 | A | * | 3/1981 | Theurer et al. | 104/2 |
| 4,274,212 | A | * | 6/1981 | Kurkela et al. | 37/218 |
| 4,354,320 | A | * | 10/1982 | Schmidt | 37/213 |
| 4,443,958 | A | * | 4/1984 | Huotari | 37/238 |
| 4,480,397 | A | * | 11/1984 | Vachon | 37/234 |
| 4,506,464 | A | * | 3/1985 | Cartner | 37/91 |
| 4,713,898 | A | * | 12/1987 | Bull et al. | 37/96 |
| 4,741,072 | A | * | 5/1988 | Wilkerson | 15/312.1 |
| 4,827,637 | A | * | 5/1989 | Kahlbacher | 37/237 |
| 4,829,684 | A | | 5/1989 | Gruber | 37/248 |
| 5,493,795 | A | * | 2/1996 | Bail | 37/104 |

* cited by examiner

*Primary Examiner*—Robert E. Pezzuto
*Assistant Examiner*—Thomas A Beach
(74) *Attorney, Agent, or Firm*—Patterson, Thuente, Skaar & Christensen, P.A.

(57) ABSTRACT

A snow removal apparatus having a frame, a first snow removal device, and a second snow removal device. The first snow removal device is operably mounted to the frame for removing snow from a front end of the frame. The second snow removal device is operably mounted to the frame for removing snow from a region lateral to a front end of the frame. The first snow removal device and the second snow removal device enable snow to be removed from a width that is wider than a width of the frame.

20 Claims, 3 Drawing Sheets

RAIL BOUNDED SNOW BLOWER EQUIPMENT

REFERENCE TO RELATED APPLICATION

The present application claims priority to U.S. Provisional Application No. 60/340,578, filed Dec. 14, 2001, and entitled "DITCHER MOUNTED SNOWBLOWER." The identified provisional application is hereby incorporated by reference in its entirety.

FIELD OF THE INVENTION

The present invention relates generally to a snow removal apparatus. More particularly, the present invention relates to a snow removal apparatus for removing snow from train tracks.

BACKGROUND OF THE INVENTION

In many climates, snow accumulates on train tracks. This snow impedes the ability of trains to move along the train tracks. When only a relatively small amount of snow has accumulated on the train tracks, it is possible to remove the snow from the train tracks with a plow. As the level of snow increases, it becomes impossible for the train to have sufficient power to push the snow off the train tracks with the plow.

To overcome this limitation and enable trains to continue operating, two-stage snow blowers have been attached to the front of trains. The first stage collects the snow and the second stage propels the snow away from the train tracks. The snow blower extends across the width of the train and thereby enables the snow to be cleared from the train tracks.

Examples of two-stage snow removal devices are found in Schmidt, U.S. Pat. No. 4,151,663; Schmidt, U.S. Pat. No. 4,354,320; and Gruber, U.S. Pat. No. 4,829,684.

SUMMARY OF THE INVENTION

The present invention is a snow removal apparatus for removing snow from train tracks that includes a first snow blowing device and a second snow blowing device. The first snow blower element is mounted to a front portion of a train car to clear snow from in front of the train car. The second snow blowing device is operably connected to the train car so that the second snow blowing device can clear snow from a region that is adjacent to the train car.

DETAILED DESCRIPTION OF THE PREFERRED EMBODIMENTS

Figure 1:
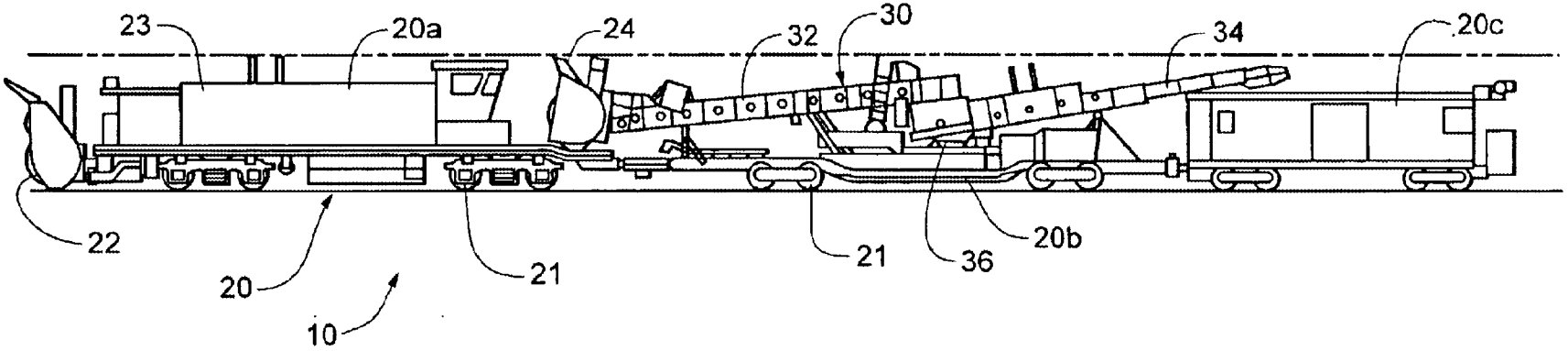
FIG. 1 is a side view of a snow removal apparatus according to the present invention.
Figure 2:
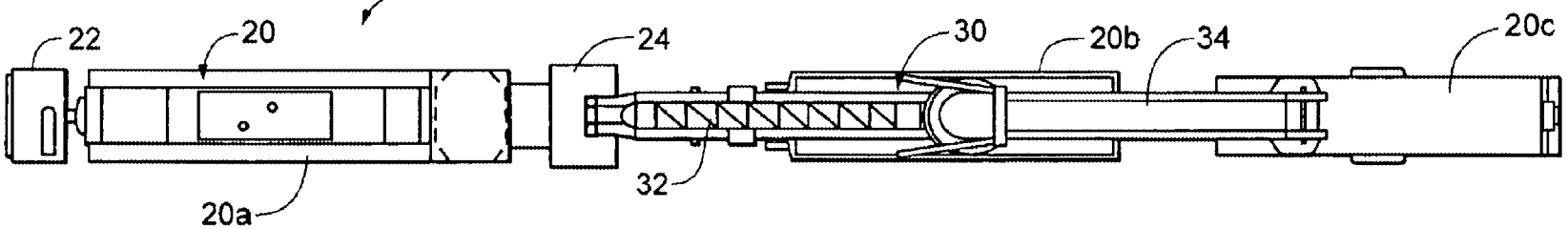
FIG. 2 is a top view of the snow removal apparatus with a second snow removal apparatus in a retracted position.

The present invention is a snow removal apparatus as most clearly illustrated at 10 in FIG. 1. The snow removal apparatus 10 generally includes at least one train car 20, a first snow removal apparatus 22 and a second snow removal apparatus 24. The first and second snow removal apparatus 22, 24 are mounted to the at least one train car 20 to clear snow from a width that is considerably wider than the width of the at least one train car 20.

The snow removal apparatus 10 of the present invention thereby provides the ability to clear snow from a path that is wider than the train. The snow removal apparatus 10 thereby reduces the time needed to remove snow from train tracks. The snow removal apparatus 10 also minimizes the potential that snow will be swept back over the train tracks after the train passes over the train tracks, which thereby reduces the frequency that the snow removal device 10 must be used on a specified length of train track.

The at least one train car 20 preferably includes a first train car 20*a* and a second train car 20*b*. The at least one train car 20 may also include a third train car 20*c*, which provides an enclosed region for persons operating the snow blowing apparatus 10 to rest, such as a conventional caboose. Each of the train cars 20*a*, 20*b* have a frame and a plurality of wheels 21 rotatably mounted to the frame.

The first train car 20*a* preferably includes a motor 23 that enables the snow removal apparatus 10 to move along the train tracks under its own power. A person of ordinary skill in the art will appreciate that it is also possible to use the snow removal apparatus 10 with a conventional locomotive or other powered rail cars (not shown).

The first snow blowing device 22 is preferably attached to the front of the first train car 20*a*. The first snow blowing device 22 preferably includes a two-stage configuration with a first stage that collects snow and conveys the snow to a second stage. The second stage conveys or blows the snow away from the train. A person of ordinary skill in the art will appreciate that a variety of snow blowing devices can be used with the concepts of the present invention.

The second snow blowing device 24 is preferably mounted to the second train car 20*b* with an arm 30. The arm 30 may include a structure that merely supports the second snow blowing device 24. Alternatively, the arm 30 may include the ability to convey snow away from the second snow blowing device 24. In this configuration, the arm 30 preferably has a structure that is similar to the arms used with railroad-mounted trench diggers, such as is disclosed in U.S. Pat. No. 4,713,898, which is assigned to the assignee of the present application, the disclosure of which is hereby incorporated by reference.

Figure 3:
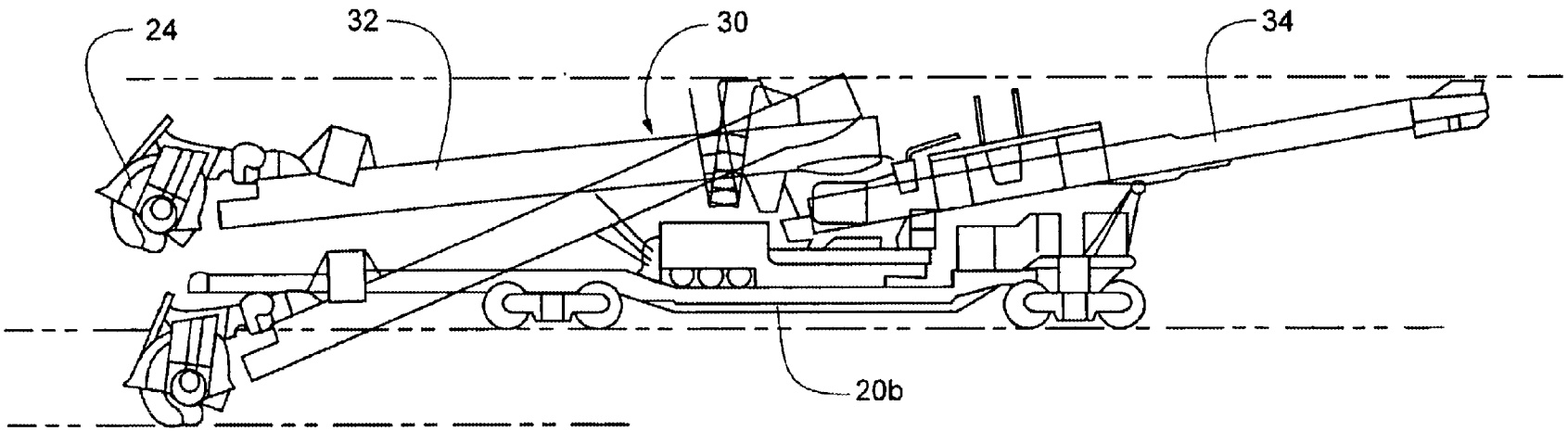
FIG. 3 is a top view of the snow removal apparatus with the second snow removal apparatus in an extended position.

The arm 30 has a first arm portion 32 and a second arm portion 34. The first arm portion 32 and the second arm portion 34 intersect proximate to a pivot axis 36 at which the arm 30 is pivotally attached to the second train car 20*b*, as most clearly illustrated in FIG. 4. The first arm portion 32 is also vertically pivotable to raise and lower the height of the second snow blowing device 24, as most clearly illustrated in FIG. 3. A person of ordinary skill in the art will appreciate that a variety of techniques may be used to control the rotation and pivoting of the arm 30.

The second snow blowing device 24 is pivotally attached to the arm 30 so that the second snow blowing device 24 can be rotated horizontally and vertically with respect to the arm 30. Movement in these directions enables the second snow blowing device 24 to be oriented towards the front of the snow removal apparatus 10 at various angular orientations of the arm 30 with respect to the second train car 20*b*.

The second snow blowing device 24 may have a configuration that is substantially similar to the configuration of the first snow blowing device 22, which includes a conventional two-stage snow blower where the first stage collects and conveys the snow to a second stage. The second stage propels or blows the snow away from the snow blower.

While not necessary, wheels or other similar devices may be mounted on the second snow blowing device 24 to support a portion of the weight of the second snow blowing device 24. For example, the wheels may be configured to roll along train tracks that are adjacent to train tracks upon which the snow removal apparatus 10 is located.

Alternatively, the second snow blowing device 24 is operably connected to a conveying system that is included in typical ditcher devices. Snow would then be collected with the second snow blower element 24 and then conveyed along the first arm portion 32 and the second arm portion before being discharged from the snow removal apparatus 10.

Figure 4:
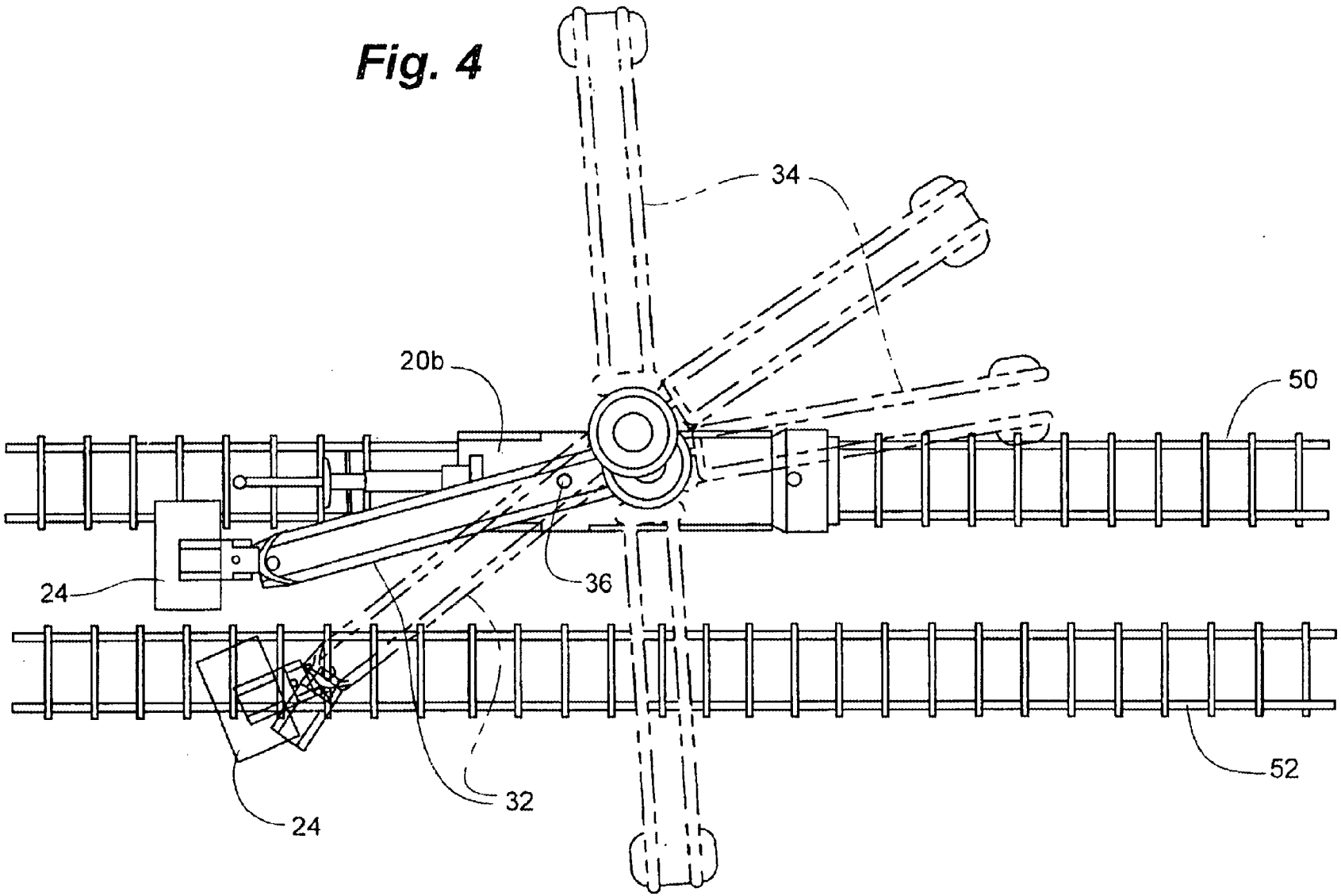
FIG. 4 is a side view of the snow removal apparatus with the second snow removal apparatus in an extended position.

In operation, the snow removal apparatus 10 is moved under its own power to a location where snow has accumulated on train tracks 50 in a retracted configuration, as illustrated in FIG. 1. The first snow blowing device 22 is activated to begin clearing snow from the train tracks 50. Next, the arm 30 is rotated so that the second snow blower element 24 is positioned adjacent to the second rail car 20*b*, as illustrated in FIG. 4. The arm 30 is then raised or lowered so that the second snow blowing device 24 is positioned proximate a ground surface. The second snow blowing device 24 is then activated to begin clearing snow from a region adjacent the train tracks 50 or from a second set of train tracks 52 that are located in proximity to the first train tracks 50.

The snow removal apparatus 10 is then moved along the train track as the first snow blowing device 22 and the second snow blowing device 24 are operating to clear snow. By using the snow removal apparatus of the present invention, the time it takes to clear snow from train tracks is greatly reduced when compared with snow removal devices that are only able to clear snow from a single set of train tracks.

The concepts of the present invention are also suited for use in applications other than trains. For example, the snow removal apparatus can be used with wheeled or track-mounted vehicles.

The concepts of the present invention are further suited for use with alternative snow removal mechanisms such as snow plows.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A snow removal apparatus comprising:

a frame;

a first snow removal device operably mounted to the frame for removing snow from a front end of the frame; and a second snow removal device operably mounted to the frame for removing snow from a region lateral to a front end of the frame, wherein the first snow removal device and the second snow removal device enable snow to be removed from a width that is wider than a width of the frame, wherein the second snow removal device is operably mounted to the frame using an arm, and wherein the arm has a conveyor for conveying snow from the second snow removal device.

2. The snow removal apparatus of claim 1, wherein the first snow removal device is a two-stage snow blower.

3. The snow removal apparatus of claim 1, wherein the second snow removal device is a two-stage snow blower.

4. The snow removal apparatus of claim 1, wherein the arm includes a first section and a second section, wherein the arm is pivotable about a pivot point proximate an intersection of the first section and the second section.

5. The snow removal apparatus of claim 1, and further comprising a plurality of wheels and a motor that are operably attached to the frame, wherein the plurality of wheels and the motor enable the snow removal apparatus to be moved under its own propulsion.

6. A train-mounted snow blowing apparatus for removing snow from a first set of railroad tracks and a second set of railroad tracks that is in proximity to but spaced apart from the first set of railroad tracks, the train-mounted snow blowing apparatus comprising:

a train car having a frame and a plurality of wheels rotatably attached thereto for engaging the first set of railroad tracks;

a first snow blowing device operably mounted to the train car for removing snow from the first set of railroad tracks;

an arm pivotally attached to the frame; and a second snow blowing device operably mounted to an end of the arm opposite the frame, wherein the arm extends beyond the frame to position the second snow removal device above the second set of railroad tracks to remove snow from the second set of railroad tracks.

7. The train-mounted snow blowing apparatus of claim 6, wherein the first snow blowing device is a two-stage snow blower.

8. The train-mounted snow blowing apparatus of claim 6, wherein the second snow blowing device is a two-stage snow blower.

9. The train-mounted snow blowing apparatus of claim 6, wherein the arm has a conveyor for conveying snow from the second snow blowing device.

10. The train-mounted snow blowing apparatus of claim 9, wherein the arm includes a first section and a second section, wherein the arm is pivotable about a pivot point proximate an intersection of the first section and the second section.

11. A method of removing snow comprising:

providing a frame having a front end;

operably mounting a first snow blowing device to the frame;

operably mounting a second snow blowing device to the frame;

removing snow from the front end with the first snow blowing device;

moving the second snow blowing device with respect to the frame to position the second snow blowing device adjacent the frame;

removing snow from a region that is lateral to the front end with the second snow blowing device, operably mounting the second snow blowing device to the frame using an arm; and conveying snow from the second snow removal device using a conveyor that is operably attached to the arm.

12. The method of claim 11, wherein the first snow blowing device is a two-stage snow blower.

13. The method of claim 11, wherein the second snow blowing device is a two-stage snow blower.

14. The method of claim 11, wherein the arm includes a first section and a second section, wherein the arm is pivotable about a pivot point proximate an intersection of the first section and the second section.

15. The method of claim 11, and further comprising mounting a plurality of wheels and a motor to the frame, wherein the plurality of wheels and the motor enable the snow removal apparatus to be moved under its own propulsion.

16. A method of simultaneously removing snow from a first set of railroad tracks and a second set of railroad tracks that is in proximity to but spaced apart from the first set of railroad tracks, the method comprising:

providing a train car having a plurality of wheels mounted thereto;

operably mounting a first snow removal device to a first end of the train car;

pivotally mounting a first end of an arm to the train car;

operably mounting a second snow removal device to a second end of the arm;

removing snow from the first set of railroad tracks with the first snow removal device;

pivoting the arm with respect to the train car to position the second snow removal device above the second set of railroad tracks; and removing snow from the second set of railroad tracks with the second snow removal device.

17. The method of claim 16, wherein the first snow removal device is a two-stage snow blower.

18. The method of claim 16, wherein the second snow removal device is a two-stage snow blower.

19. The method of claim 16, wherein the arm includes a first section and a second section, wherein the arm is pivotable about a pivot point proximate an intersection of the first section and the second section.

20. The method of claim 16, and further comprising moving the train car with respect to the first set of tracks using a motor operably attached to at least one of the plurality of wheels.

* * * * *